US007316220B2

(12) United States Patent
Kikutani

(10) Patent No.: US 7,316,220 B2
(45) Date of Patent: Jan. 8, 2008

(54) ACTUATOR DRIVE SYSTEM AND FUEL INJECTION SYSTEM

(75) Inventor: Takashi Kikutani, Ama-gun (JP)

(73) Assignee: Denso Corporation, Kariya, Aichi-pref. (JP)

( * ) Notice: Subject to any disclaimer, the term of this patent is extended or adjusted under 35 U.S.C. 154(b) by 462 days.

(21) Appl. No.: 11/007,153

(22) Filed: Dec. 9, 2004

(65) Prior Publication Data

US 2005/0126534 A1 Jun. 16, 2005

(30) Foreign Application Priority Data

Dec. 12, 2003 (JP) ..... 2003-415133

(51) Int. Cl.
*F02M 37/04* (2006.01)

(52) U.S. Cl. ..... 123/501; 123/467

(58) Field of Classification Search ..... 123/467, 123/500, 501, 458, 494, 506, 514, 498
See application file for complete search history.

(56) References Cited

U.S. PATENT DOCUMENTS 6,253,736 B1 * 7/2001 Crofts et al. ..... 123/498
6,367,453 B1 * 4/2002 Igashira et al. ..... 123/467
6,617,755 B2 9/2003 Kawamoto
6,691,682 B2 * 2/2004 Rueger et al. ..... 123/467
6,718,946 B2 * 4/2004 Hokazono et al. ..... 123/445
6,837,221 B2 * 1/2005 Crofts et al. ..... 123/467

FOREIGN PATENT DOCUMENTS

JP A-7-71639 3/1995

OTHER PUBLICATIONS

Chinese Examination Report dated Jan. 29, 2007.

* cited by examiner

*Primary Examiner*—Carl S. Miller
(74) *Attorney, Agent, or Firm*—Nixon & Vanderhye P.C.

(57) ABSTRACT

A control device of a fuel injection system of an engine calculates command injection timing for starting an injection at target injection timing, and a command injection period for obtaining a target injection quantity. The control device monitors a charging voltage of a capacitor immediately before the command injection timing and estimates the charging voltage at the command injection timing based on the monitored value. If the estimated value is less than a specified value, the control device performs correction for advancing the command injection timing and correction for lengthening the command injection period in accordance with the decrease in the charging voltage. Thus, an injector can start the injection at the target injection timing and can inject the target injection quantity of fuel.

18 Claims, 5 Drawing Sheets

ACTUATOR DRIVE SYSTEM AND FUEL INJECTION SYSTEM

CROSS REFERENCE TO RELATED APPLICATION

This application is based on and incorporates herein by reference Japanese Patent Application No. 2003-415133 filed on Dec. 12, 2003.

BACKGROUND OF THE INVENTION

1. Field of the Invention

The present invention relates to an actuator drive system and a fuel injection system having an actuator, which is driven by electrical energy stored in a charge circuit.

2. Description of Related Art

An example of an actuator drive system and a fuel injection system is shown in FIG. 5A. In the technology shown in FIG. 5A (for instance, which is disclosed in Unexamined Japanese Patent Application Publication No. H07-71639), a capacitor (a condenser) 44 of a charge circuit 41 stores a large amount of electrical energy (a high voltage). When an injector 3 is driven, the electrical energy stored in the capacitor 44 and electrical energy provided by a constant current circuit 42 are supplied to an electromagnetic valve 32 mounted on the injector 3. Thus, response of the electromagnetic valve 32 is improved, so response of the injector 3 is improved.

If a selection switch 43 disposed in an energization circuit of the injector 3 is turned on at command injection timing a1 (shown in FIG. 5B) to operate the injector 3, the electrical energy stored in the capacitor 44 and the electrical energy provided by the constant current circuit 42 are supplied to the injector 3 as shown by a curved line (an injection pulse signal) a2 in FIG. 5B indicating a driving current I. The timing a1 is timing for outputting a command signal to the injector 3. Thus, the injector 3 starts the injection at the target injection timing. The system shown in FIG. 5A energizes the injector 3 by a multi-switching method. A switch 47 separates the capacitor 44 if the driving current I reaches a predetermined current (a peak current).

At that time, since the electrical energy stored in the capacitor 44 is supplied to the injector 3, the capacitor 44 is discharged and a charging voltage V decreases as shown by a part a3 of a solid line indicating the charging voltage V in FIG. 5B.

A control device controlling the charging voltage V of the capacitor 44 monitors the charging voltage V. If the charging voltage V decreases from a specified value (a fully-charged voltage) Vf, the control device operates a charging unit 45 of the charge circuit 41 to increase the charging voltage V of the capacitor 44 to the specified value Vf. Thus, the charging voltage V of the capacitor 44 increases to the specified value Vf as shown by a part a4 of the solid line indicating the charging voltage V in FIG. 5B.

In recent years, in order to achieve prevention of engine vibration and engine noise, purification of exhaust gas, and improvement of engine output and gas mileage at the same time at a high level, it is required to perform multiple injections (a multi-injection) in a compression and expansion stroke of a cylinder (a period suitable for performing fuel injection for generating engine torque).

In the case where the multi-injection is not performed, the number of times of the injections is small. Therefore, there is an adequate period to charge the capacitor 44 after the capacitor 44 is discharged. However, if the multi-injection is performed, an interval between the injection and the next injection is shortened. In this case, there is a possibility that the next injection is started before the charging voltage V of the capacitor 44 reaches the specified value Vf.

If a certain level of the interval is provided between the command injection timing a1 and next command injection timing b1 as shown in FIG. 5B, the capacitor 44, which is discharged at the command injection timing a1, can be charged by the next command injection timing b1. If the selection switch 43 is turned on at the command injection timing b1, the electrical energy stored in the capacitor 44 and the electrical energy provided by the constant current circuit 42 are supplied to the injector 3 as shown by a curved line b2 in FIG. 5B indicating the driving current I. Thus, the injector 3 can perform a predetermined injection operation. More specifically, the injector 3 starts the injection at target injection timing and performs the injection for a target injection period.

Also in this case, the capacitor 44 is discharged and the charging voltage V decreases as shown by a part b3 of the solid line indicating the charging voltage V in FIG. 5B. Therefore, the charging operation is performed to increase the charging voltage V of the capacitor 44 to the specified value Vf as shown by a part b4 of the solid line indicating the charging voltage V in FIG. 5B.

However, an interval between the command injection timing b1 and next command injection timing c1 is short as shown in FIG. 5B. Therefore, there is a possibility that the command injection timing c1 is reached while the charging voltage V is increasing as shown by the part b4 of the solid line indicating the charging voltage V in FIG. 5B.

In such a case, if the selection switch 43 is turned on at the command injection timing c1, at which the capacitor 44 is still being charged, the electrical energy, which is stored in the capacitor 44 and is less than the specified value Vf, and the electrical energy provided by the constant current circuit 42 are supplied to the injector 3. As a result, the electrical energy supplied to the injector 3 in accordance with a pulse signal c2 of the driving current I in FIG. 5B is relatively low.

If the electrical energy supplied to the injector 3 decreases, the driving force of the electromagnetic valve 32 decreases and the response of the electromagnetic valve 32 is delayed. As a result, actual injection timing (timing when the fuel injection from the injector 3 is actually started) is delayed from the target injection timing.

If the actual injection timing is delayed, an actual injection period (a period in which the injector 3 actually injects the fuel) is shortened. As a result, the target injection quantity of the fuel cannot be injected.

In the system of the related art shown in FIG. 5A, which includes the constant current circuit 42 in addition to the charge circuit 41, the rising of the current at the time when the constant current circuit 42 starts outputting the current will be changed if a constant current switch 46 of the constant current circuit 42 is turned on when the driving voltage applied to the injector 3 is lower than the specified value. Accordingly, the electrical energy supplied to the injector 3 is also changed by the change in the rising of the current. Therefore, the response of the injector 3 is changed and the actual injection timing and the actual injection quantity are changed.

In order to solve the above problems, a method of increasing a capacity of the capacitor 44 to store excessive electrical energy in the capacitor 44 or a method of mounting a multiplicity of capacitors 44 so that the capacitors 44 correspond to the respective injections of the multi-injection can be employed. However, the body size of the charge circuit 41 will increase and the cost of the charge circuit 41 will increase.

SUMMARY OF THE INVENTION

It is therefore an object of the present invention to provide an actuator drive system capable of making an actuator perform a predetermined operation even if electrical energy supplied to an actuator deviates from a specified value.

It is another object of the present invention to provide a fuel injection system capable of conforming actual injection timing to target injection timing even if electrical energy supplied to an injector deviates from a specified value.

It is yet another object of the present invention to provide a fuel injection system capable of conforming an actual injection quantity to a target injection quantity even if electrical energy supplied to an injector deviates from a specified value.

According to an aspect of the present invention, a control device of an actuator drive system monitors electrical energy stored in a charge circuit and corrects the electrical energy, which is supplied to an actuator, in accordance with the monitored value. Thus, the actuator drive system can make the actuator perform a predetermined operation even if the electrical energy supplied to the actuator deviates from a specified value.

According to another aspect of the present invention, a control device of a fuel injection system monitors electrical energy stored in a charge circuit immediately before command injection timing and estimates the electrical energy at the command injection timing based on the monitored value. The control device corrects the command injection timing based on the estimated value to make an injector inject fuel at target injection timing. More specifically, the control device corrects the command injection timing in accordance with the electrical energy stored in the charge circuit, which is estimated from the monitored value, so that actual injection timing coincides with the target injection timing.

According to yet another aspect of the present invention, a control device of a fuel injection system monitors electrical energy stored in a charge circuit immediately before a command injection period and estimates the electrical energy at a start of the command injection period based on the monitored value. The control device corrects the command injection period based on the estimated value to make an injector inject a target injection quantity of fuel. More specifically, the control device corrects the command injection period in accordance with the electrical energy stored in the charge circuit, which is estimated from the monitored value, so that an actual injection quantity coincides with the target injection quantity.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
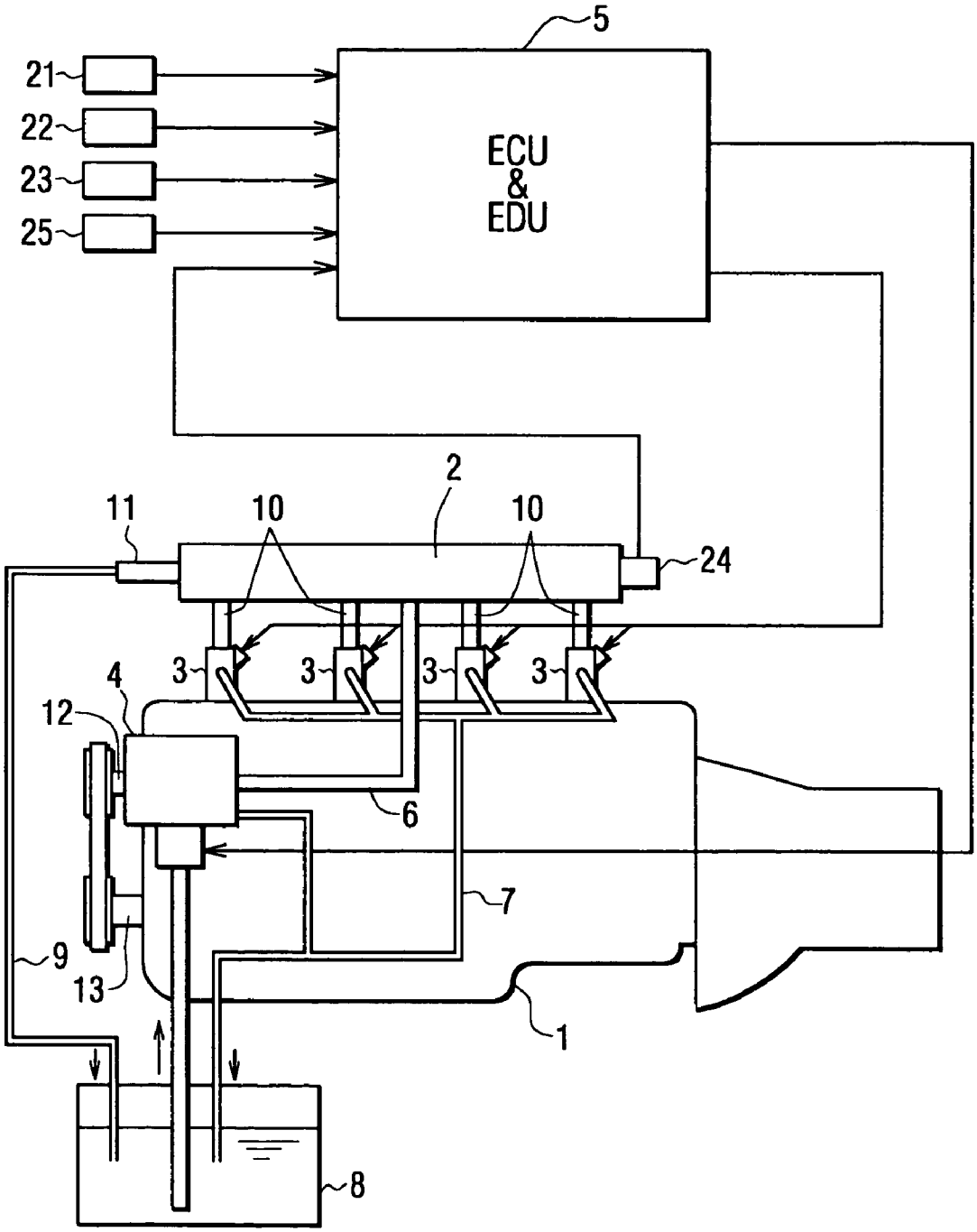
FIG. 1 is a schematic diagram showing a common rail type fuel injection system according to an embodiment of the present invention.

Referring to FIG. 1, a common rail type fuel injection system according to an embodiment of the present invention is illustrated. The fuel injection system shown in FIG. 1 injects fuel into a diesel engine 1, for instance. The fuel injection system includes a common rail 2, injectors 3, a supply pump 4, and a control device 5.

The engine 1 includes multiple cylinders. Each cylinder continuously performs an intake stroke, a compression stroke, an explosion stroke and an exhaustion stroke in that order. The engine 1 shown in FIG. 1 is a four-cylinder engine. Alternatively, the engine 1 may have other number of cylinders.

The common rail 2 is an accumulation vessel for accumulating high-pressure fuel, which is supplied to the injectors 3. The common rail 2 is connected with a discharge hole of the supply pump 4 through a fuel pipe (a high-pressure fuel passage) 6. The supply pump 4 pressure-feeds the high-pressure fuel to the common rail 2. Thus, the common rail 2 can accumulate the fuel at a common rail pressure corresponding to a fuel injection pressure.

Leak fuel leaking from the injectors 3 is returned to a fuel tank 8 through a leak pipe (a fuel return passage) 7.

A pressure limiter 11 is disposed in a relief pipe (a fuel return passage) 9 leading from the common rail 2 to the fuel tank 8. The pressure limiter 11 is a pressure safety valve. The pressure limiter 11 opens to limit the common rail pressure under a limit set pressure if the common rail pressure exceeds the limit set pressure.

The injectors 3 are mounted to the respective cylinders of the engine 1 to inject the fuel into the cylinders. The injectors 3 are connected to downstream ends of high-pressure fuel pipes 10 branching from the common rail 2 and inject the high-pressure fuel, which is accumulated in the common rail 2, into the respective cylinders.

Figure 2:
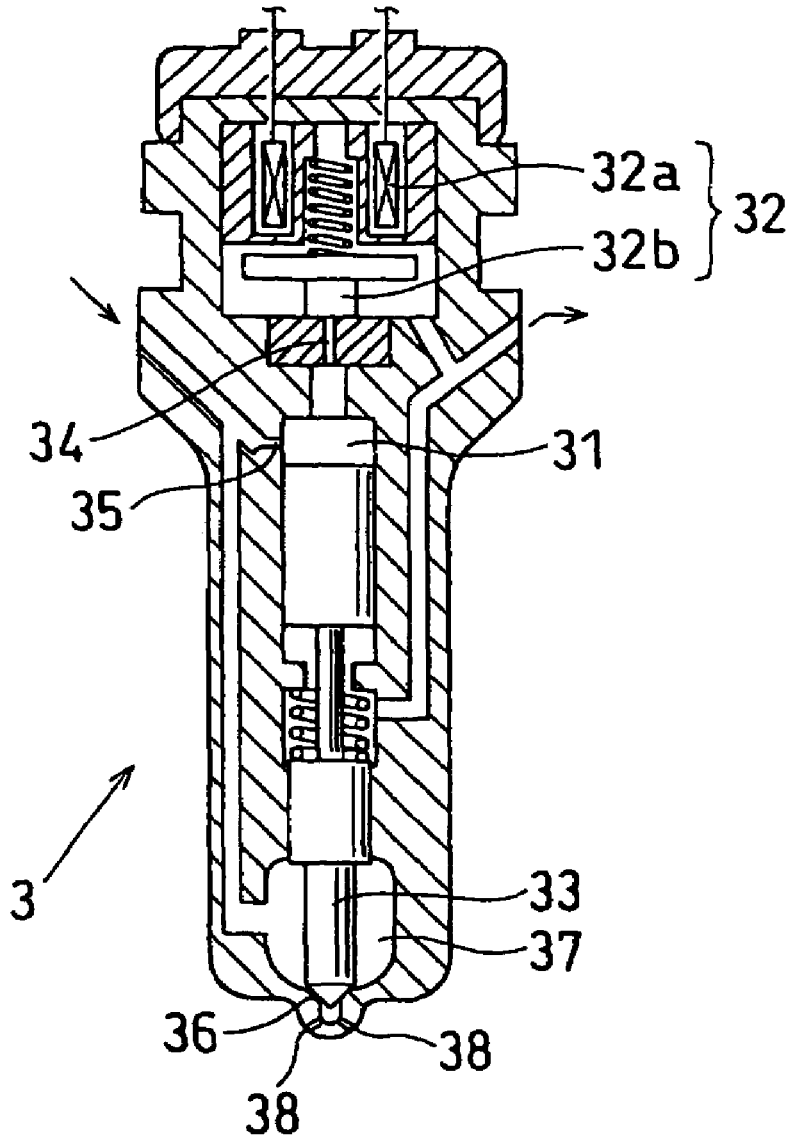
FIG. 2 is a longitudinal cross-sectional view showing an injector of the fuel injection system according to the embodiment.

Structure of the injector 3 is shown in FIG. 2. The injector 3 is an electromagnetic fuel injection valve for controlling a pressure in a control chamber (a back pressure chamber) 31 with an electromagnetic valve 32 and for driving a needle (a valve member) 33 by the pressure in the control chamber 31. The electromagnetic valve 32 is made up of an electromagnetic solenoid 32*a* and a valve (a movable member) 32*b*. The electromagnetic valve 32 corresponds to an actuator.

If an injection signal (one of pulse signals a2, b2, c2 shown in FIG. 3B) is provided to the electromagnetic solenoid 32*a* of the electromagnetic valve 32 of the injector 3, the valve 32*b* starts moving upward. Thus, an out-orifice 34 is opened and the pressure in the control chamber 31, which is depressurized by an in-orifice 35, starts decreasing.

If the pressure in the control chamber 31 decreases under a valve opening pressure, the needle 33 starts ascending. If the needle 33 separates from a nozzle seat 36, a nozzle chamber 37 communicates with injection holes 38. Thus, the fuel pressure-fed to the nozzle chamber 37 at a high pressure is injected through the injection holes 38.

If the injection signal (the pulse signal) provided to the electromagnetic solenoid 32*a* of the electromagnetic valve 32 is stopped, the valve 32*b* starts moving downward. If the valve 32*b* closes the out-orifice 34, the pressure in the control chamber 31 starts increasing. If the pressure in the control chamber 31 increases above a valve closing pressure, the needle 33 starts descending.

If the needle 33 descends and is seated on the nozzle seat 36, the communication between the nozzle chamber 37 and the injection holes 38 is broken and the fuel injection from the injection holes 38 is stopped.

The supply pump 4 is a fuel pump for pressure-feeding the high-pressure fuel to the common rail 2. The supply pump 4 has a feed pump and a high-pressure pump. The feed pump draws fuel from the fuel tank 8 into the supply pump 4. The high-pressure pump pressurizes the drawn fuel to a high pressure and pressure-feeds the fuel to the common rail 2. The feed pump and the high-pressure pump are driven by a common camshaft 12. The camshaft 12 is driven and rotated by a crankshaft 13 and the like of the engine 1 as shown in FIG. 1.

The supply pump 4 includes a drawing quantity control valve for controlling a quantity of the fuel drawn by the high-pressure pump. The control device 5 controls the drawing quantity control valve to regulate the common rail pressure.

The control device 5 includes an engine control unit (ECU) and an electric drive unit (EDU). The ECU performs various types of calculation and outputs command signals for controlling the engine 1. The EDU includes an injector drive circuit and a pump drive circuit. The ECU and the EDU are disposed in the same control device 5 in FIG. 1. Alternatively, the control device 5 may be structured by disposing the ECU and the EDU separately.

The ECU is a microcomputer of publicly known structure. The ECU has functions of CPU for performing control calculation processing, a memory device (a memory such as ROM, standby RAM, EEPROM or RAM) for storing various types of programs and data, an input circuit, an output circuit, a power source circuit and the like. The ECU performs the various types of calculation processing based on signals outputted by sensors (engine parameters: signals corresponding to a manipulating state of vehicle occupants and an operating state of the engine 1, for instance).

The sensors connected to the ECU include an accelerator position sensor 21 for sensing an accelerator position ACCP, a rotation speed sensor 22 for sensing an engine rotation speed ω, a water temperature sensor 23 for sensing temperature of cooling water of the engine 1, a common rail pressure sensor 24 for sensing the common rail pressure, and other sensors 25 as shown in FIG. 1.

Figure 3A:
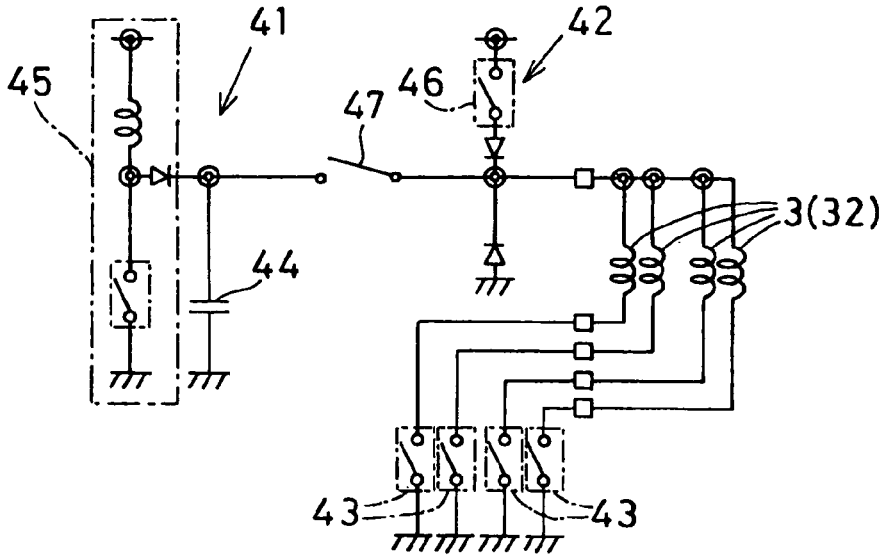
FIG. 3A is a circuit diagram showing a substantial portion of a control device of the fuel injection system according to the embodiment.

Next, structure of a substantial portion of the injector drive circuit of the EDU will be explained based on FIG. 3A.

The injector drive circuit of the present embodiment includes a charge circuit 41, a constant current circuit 42, and selection switches (cylinder switches) 43 of the respective injectors 3. When the injector 3 is operated (or when the selection switch 43 is turned on), electrical energy stored in a capacitor (a condenser) 44 of the charge circuit 41 is supplied to the injector 3 (more specifically, to the electromagnetic valve 32 of the injector 3). Thus, the response of the injector 3 (the response of the electromagnetic valve 32) is improved.

The charge circuit 41 includes a charging unit 45 for generating a high voltage by increasing a battery voltage, and the capacitor 44 for storing the high voltage generated by the charging unit 45.

The control device 5 monitors the charging voltage V of the capacitor 44. If the charging voltage V of the capacitor 44 decreases from a specified value (a predetermined fully-charged voltage) Vf, the control device 5 operates the charging unit 45 of the charge circuit 41 to conform the charging voltage V of the capacitor 44 to the specified value Vf. Thus, the charging voltage V of the capacitor 44 is increased to the specified value Vf.

The constant current circuit 42 may be a circuit for generating a predetermined current, or a circuit directly connected with the battery.

Next, injector control performed by the control device 5 of the present embodiment will be explained.

The common rail type fuel injection system of the present embodiment can perform multiple fuel injections (a multi-injection) during one compression and expansion stroke in accordance with the operating state of the engine 1. BY performing the multi-injection, prevention of engine vibration and engine noise, purification of exhaust gas, and improvement of engine output and gas mileage can be achieved at the same time at a high level. The ECU of the control device 5 performs the drive control of each injector 3 based on the programs (maps and the like) stored in the ROM and the engine parameters inputted to the RAM for each fuel injection.

The ECU of the control device 5 has an injection timing calculating function and an injection period calculating function as the programs for the drive control of the injector 3.

The injection timing calculating function is a control program for calculating target injection timing in accordance with the present operating state and command injection timing for starting the injection at the target injection timing, and for outputting an injection start signal to the EDU at the command injection timing. The injection start signal is rising of an injector signal. The injector signal is a signal for operating the injector 3. When the injector signal is on, the injector 3 operates. When the injector signal is off, the operation of the injector 3 is stopped.

The injection period calculating function is a control program for calculating a target injection quantity in accordance with the present operating state and a command injection period for obtaining the target injection quantity, and for generating an injection continuation signal (the injector signal) for performing the injection during the command injection period.

The EDU of the control device 5 turns on a constant current switch 46 of the constant current circuit 42 if the injector signal is provided from the ECU to the EDU, and keeps the state and flips on and off the selection switch 43 disposed in a circuit of the injector 3 at a high speed while the injector signal is on.

If the injector signal is provided from the ECU to the EDU, a large amount of the electrical energy (the high voltage) mainly stored in the capacitor 44 of the charge circuit 41 is supplied to the electromagnetic valve 32, first. Therefore, the injector 3 can start the fuel injection with quick response. Then, if the peak of the driving current I reaches a predetermined current value, a switch 47 is turned off to separate the capacitor 44. Meanwhile, the constant current mainly provided by the constant current circuit 42 is supplied to the electromagnetic valve 32 while the injector signal is provided as shown by each one of curved lines a2, b2, c2 in FIG. 3B indicating the driving current I. Thus, the injector 3 is kept open.

Since the multi-injection is performed in the present embodiment, the interval between the injection and the next injection is short. Therefore, there is a possibility that the next injection is started before the charging voltage V of the capacitor 44 reaches the specified value Vf.

Figure 3B:
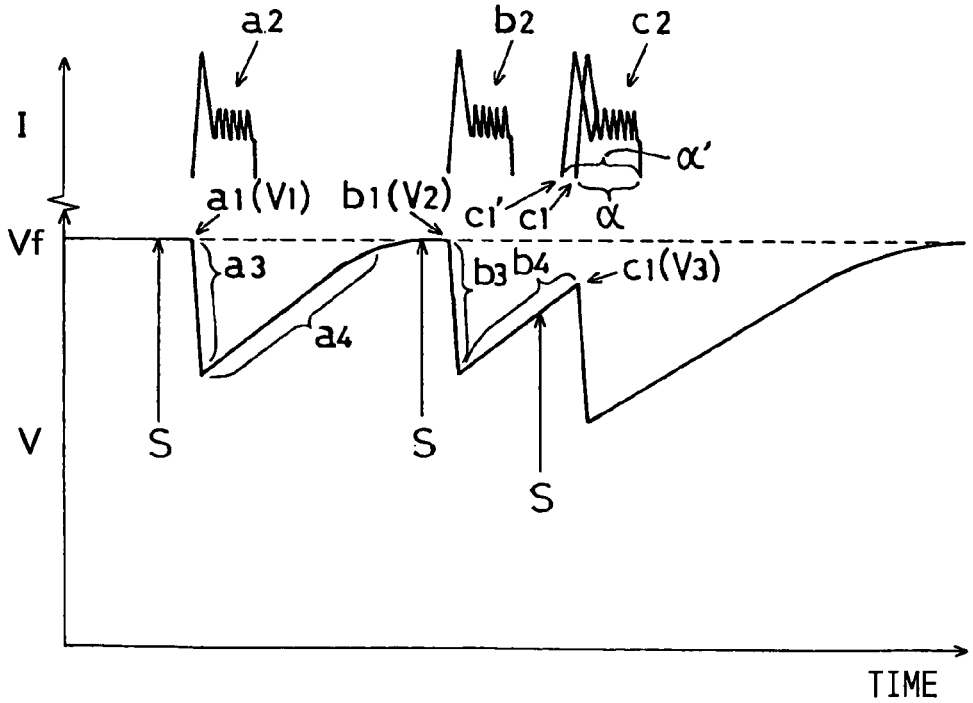
FIG. 3B is a time chart showing waveforms of a charging voltage and a driving current of the fuel injection system according to the embodiment.

In FIG. 3B, there is a certain level of interval between command injection timing a1 and next command injection timing b1. Therefore, the capacitor 44 can be charged by the next command injection timing b1 after the capacitor 44 is discharged at the command injection timing a1. Therefore, the injector 3 can perform a predetermined injection operation. More specifically, the injector 3 can start the injection at the target injection timing and can perform the injection for the target injection period.

However, an interval between the command injection timing b1 and next command injection timing c1 is short as shown in FIG. 3B. If the command injection timing c1 is reached while the charging voltage V is increasing as shown by a part b4 of a solid line indicating the charging voltage V in FIG. 3B, the selection switch 43 is turned on at the command injection timing c1 while the capacitor 44 is being charged. At that time, the charging voltage V of the capacitor 44 has not reached the specified value Vf. Accordingly, the electrical energy supplied to the injector 3 in accordance with the pulse signal c2 shown in FIG. 3B is relatively low. Thus, the response of the injector 3 (the electromagnetic valve 32) is delayed and the valve opening timing is delayed. More specifically, the actual injection timing is delayed from the target injection timing.

If the actual injection timing is delayed, the actual injection period is shortened, and the target injection quantity of the fuel cannot be injected.

In order to solve the above problem, in the present embodiment, the injection timing calculating function and the injection period calculating function include correcting means explained below.

The injection timing calculating function includes energization timing correcting means. The energization timing correcting means monitors the electrical energy stored in the charge circuit 41 (the charging voltage V of the capacitor 44) at sampling timing S (shown in FIG. 3B) immediately before the command injection timing a1, b1, c1. Each sampling timing S is earlier than each one of the command injection timing a1, b1, c1 by several tens of microseconds, for instance. The energization timing correcting means estimates the electrical energy, or the charging voltages V1, V2, V3, at the respective command injection timing a1, b1, c1 based on the monitored values. The energization timing correcting means corrects the command injection timing (the timing for generating the injector signal) based on each one of the estimated charging voltages V1, V2, V3. Thus, the energization timing correcting means makes the injector 3 inject the fuel at the target injection timing.

When the estimated voltage is lower than the specified value (the fully-charged voltage Vf), the energization timing correcting means performs the control for advancing the command injection timing (the start timing of the injector signal) in accordance with the decrease in the estimated voltage from the specified value Vf. A correction value for correcting the command injection timing in accordance with the estimated voltage corresponds to a value for correcting the change in the response time of the injector 3 (the electromagnetic valve 32), which is caused if the electric energy (the charging voltage V) stored in the capacitor 44 decreases from the specified value Vf.

An increasing characteristic of the charging voltage V of the capacitor 44, or an inclination of the solid line indicating the charging voltage V of the capacitor 44, depends on the battery voltage. Therefore, the control device 5 reads the battery voltage with the use of battery voltage sensing means when the control device 5 monitors the charging voltage V at the timing S shown in FIG. 3B. Thus, the control device 5 calculates the estimate of the voltage V from the monitored value in accordance with the increasing characteristic of the charging voltage V based on the battery voltage and the interval between the sampling timing S and the command injection timing, by using maps or equations.

The injection period calculating function includes injection period correcting means for correcting the command injection period based on each one of the estimated voltages V1, V2, V3 obtained at the timing S immediately before the command injection timing a1, b1, c1. Thus, the injection period correcting means makes the injector 3 inject the target injection quantity of the fuel.

When the estimated voltage is lower than the specified value (the fully-charging voltage) Vf, the injection period correcting means performs the control for lengthening the command injection period (the period for generating the injector signal) in accordance with the decrease in the estimated voltage. A correction value for correcting the command injection period in accordance with the estimated voltage corresponds to a value for correcting the change in the response time of the injector 3 (the electromagnetic valve 32), which is caused if the electrical energy (the charging voltage V) stored in the capacitor 44 decreases from the specified value Vf.

In the case where the interval between the command injection timing b1 and the next command injection timing c1 is short and the next command injection timing c1 is reached while the charging voltage V is increasing as shown by the part b4 of the solid line indicating the charging voltage V in FIG. 3B, the electrical energy (the charging voltage) V of the capacitor 44 is monitored at the sampling timing S immediately before the command injection timing c1. Then, the electrical energy (the charging voltage) V3 at the command injection timing (the start timing of the command injection period) c1 is estimated based on the monitored value. Then, based on the estimated voltage V3, the command injection timing c1 is corrected to the command injection timing c1' and the command injection period $\alpha$ is corrected to the command injection period $\alpha'$ as shown in FIG. 3B.

Next, the above operation will be explained based on FIGS. 4A, 4B and 4C. In the operation shown in FIGS. 4A to 4C, the target injection period is calculated from the target injection quantity, and the command injection period for obtaining the target injection period is calculated. Alternatively, the command injection period may be calculated directly from the target injection quantity.

Figure 4A:
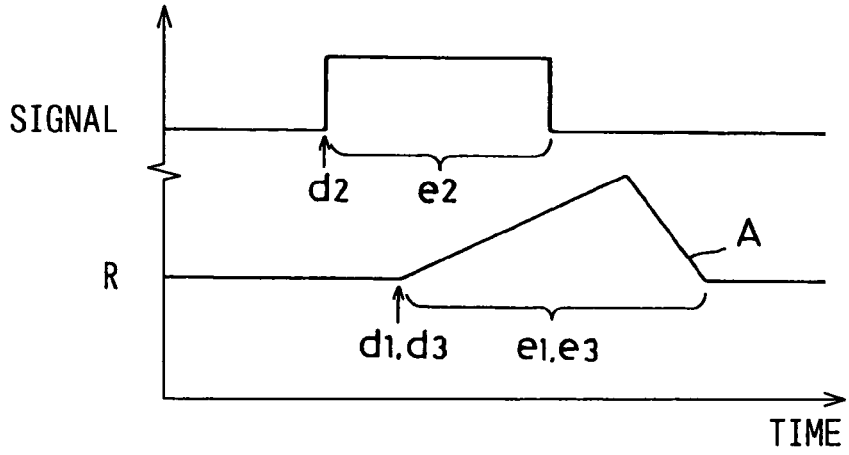
FIG. 4A is a time chart showing an injector signal and an injection rate of the fuel injection system according to the embodiment.
Figure 4B:
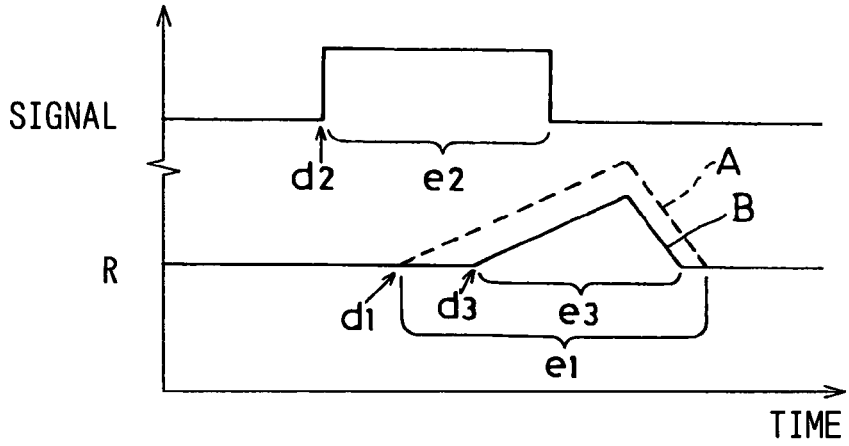
FIG. 4B is another time chart showing the injector signal and the injection rate of the fuel injection system according to the embodiment.

In the case where the target injection timing calculated in accordance with the operating state is timing d1 and the target injection period corresponding to the target injection quantity is a period e1, the ECU of the control device 5 calculates command injection timing d2 corresponding to the target injection timing d1 based on maps and the like, and calculates a command injection period e2 corresponding to the target injection period e1 as shown by a solid line in FIG. 4A indicating the injector signal "SIGNAL".

If the command injection timing d2 is reached, the selection switch 43 disposed on the circuit of the injector 3, which is supposed to perform the fuel injection for the command injection period e2, is turned on (or is flipped on and off at a high speed). Thus, the electrical energy is supplied to the injector 3.

If the electrical energy (the charging voltage) V stored in the capacitor 44 is equal to the specified value Vf, the injection is started at the target injection timing d1 as shown by a solid line "A" in FIG. 4A and the injection is performed for the target injection period e1. The solid line "A" in FIG. 4A indicates an injection rate "R". Thus, the actual injection timing d3 coincides with the target injection timing d1, and the actual injection period e3 coincides with the target injection period e1.

However, if the electrical energy (the charging voltage) V stored in the capacitor 44 is lower than the specified value Vf, the driving force of the valve 32*b* provided by the electromagnetic solenoid 32*a* is reduced and the response of the electromagnetic valve 32 is delayed. As a result, the response of the injector 3 is delayed. Accordingly, the actual injection timing d3 lags behind the target injection timing d1 as shown by a solid line "B" in FIG. 4B. Due to the delay in the actual injection timing d3, the actual injection period e3 becomes shorter than the target injection period e1. As a result, the target injection quantity of the fuel cannot be injected.

Figure 4C:
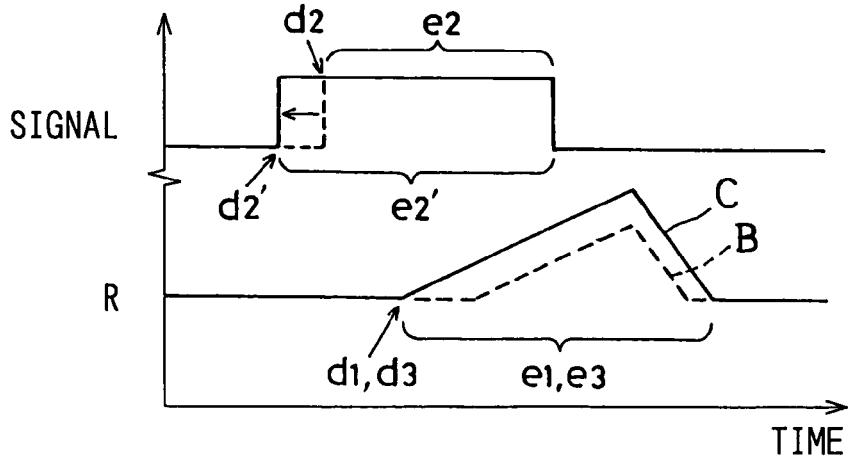
FIG. 4C is yet another time chart showing the injector signal and the injection rate of the fuel injection system according to the embodiment.
Figure 5A:
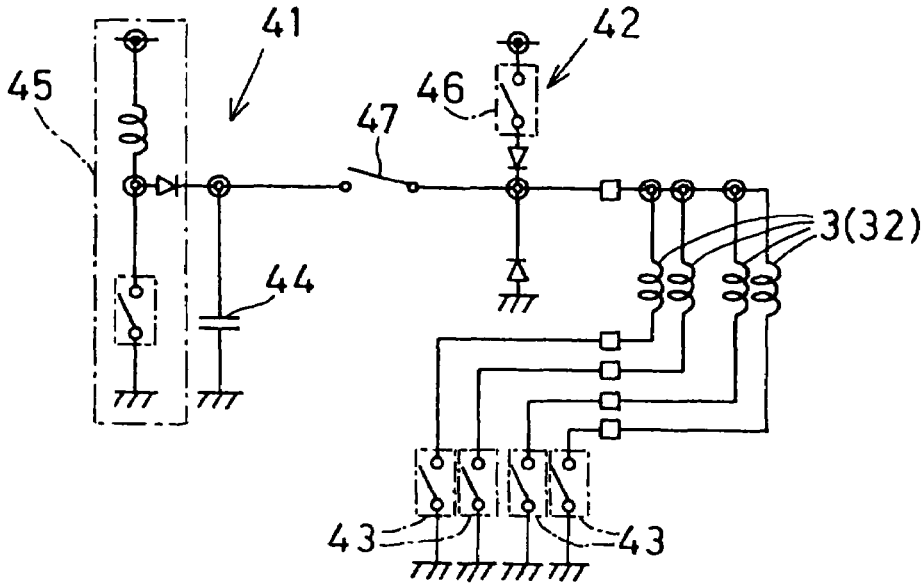
FIG. 5A RELATED ART
FIG. 5A is a circuit diagram showing a substantial portion of a control device of a fuel injection system of a related art.
Figure 5B:
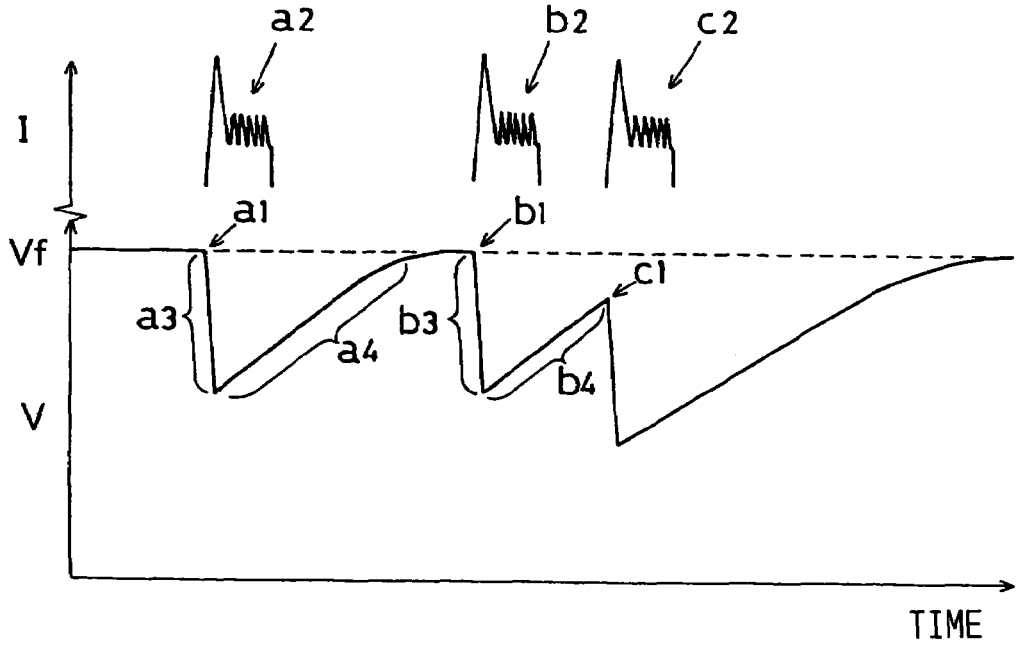
FIG. 5B RELATED ART
FIG. 5B is a time chart showing waveforms of a charging voltage and a driving current of the fuel injection system of the related art.

In contrast, the correction technology of the present embodiment advances the command injection timing d2 to the corrected command injection timing d2' as shown in FIG. 4C if the electrical energy stored in the capacitor 44 is lower than the specified value Vf. Thus, the delay in the response of the injector 3 is corrected as shown by a solid line "C" in FIG. 4C. As a result, the injection can be started at the target injection timing d1.

The command injection period e2 is lengthened and corrected to the command injection period e2'. Thus, the delay in the response of the injector 3 is corrected. As a result, the injection is performed for the target injection period e1 and the target injection quantity of the fuel is injected.

As explained above, the common rail type fuel injection system of the present embodiment corrects both the command injection timing and the command injection period based on the estimated electrical energy, which is obtained immediately before the command injection timing. Thus, the fuel injection system corrects the delay in the response of the injector 3 to conform the actual injection timing to the target injection timing and to conform the actual injection quantity to the target injection quantity.

More specifically, even if the electrical energy supplied from the charge circuit 41 to the actuator (the electromagnetic valve 32 in the present embodiment) deviates from the specified value, the system can make the actuator perform a predetermined operation.

(Modifications)

In the above embodiment, the electromagnetic valve 32, which drives the valve 32*b* with the use of the electromagnetic solenoid 32*a*, is employed as the actuator. Alternatively, any other types of actuators such as an actuator driving a driven member with the use of a magnetostrictive element or an actuator driving the driven member with the use of a piezoelectric element may be employed.

In the above embodiment, the injector 3 controls the pressure in the control chamber 31 with the use of the electromagnetic valve 32 and drives the needle 33 by changing the pressure in the control chamber 31. Alternatively, an injector, in which an actuator (an electromagnetic actuator, an actuator using a magnetostrictive element, or an actuator using a piezoelectric element) directly drives the needle (the valve member) 33, may be employed.

In the above embodiment, the correction is performed based on the charging voltage, which is applied to the actuator by the charge circuit 41, so that the actuator performs the predetermined operation. Alternatively, the correction may be performed based on the current, which is applied to the actuator by the charge circuit 41, so that the actuator performs the predetermined operation.

In the above embodiment, the correction for advancing the operation start timing of the actuator and for lengthening the operation period of the actuator is performed when the electrical energy supplied from the charge circuit 41 to the actuator is lower than the specified value. Alternatively, correction for delaying the operation start timing of the actuator and for shortening the operation period of the actuator may be performed when the electrical energy supplied from the charge circuit 41 to the actuator is higher than the specified value.

In the above embodiment, the present invention is applied to the common rail type fuel injection system. Alternatively, the present invention may be applied to a fuel injection system having no common rail. More specifically, the present invention may be applied to a fuel injection system used in a gasoline engine and the like, other than the diesel engine.

In the above embodiment, the present invention is applied to the control of the injector 3. Alternatively, the present invention may be applied to any other kind of actuator than the injector 3 in order to perform the correction based on electrical energy, which is supplied from the charge circuit 41 to the actuator, so that the actuator can perform a predetermined operation.

The present invention should not be limited to the disclosed embodiment, but may be implemented in many other ways without departing from the spirit of the invention.

What is claimed is:

1. A fuel injection system of an internal combustion engine, the fuel injection system comprising:

a charge circuit for storing electrical energy;

an injector having an actuator, which is driven by the electrical energy stored in the charge circuit, and a valve member, which is driven to open or to close by the actuator directly or indirectly, wherein the injector injects high-pressure fuel by opening and closing the valve member; and a control device for calculating target injection timing corresponding to an operating state of the engine and command injection timing for starting the injection at the target injection timing, and for making the injector inject the fuel at the target injection timing by supplying the electrical energy from the charge circuit to the actuator at the command injection timing, wherein the control device includes timing correcting means for monitoring the electrical energy stored in the charge circuit immediately before the command injection timing and for estimating the electrical energy at the command injection timing based on the monitored value of the electrical energy, the timing correcting means correcting the command injection timing based on the estimated electrical energy so that the injector injects the fuel at the target injection timing.

2. The fuel injection system as in claim 1, wherein the control device calculates a target injection quantity corresponding to the operating state of the engine and a command injection period for obtaining the target injection quantity, and makes the injector inject the target injection quantity of the fuel by supplying the electrical energy from the charge circuit to the actuator for the command injection period, and the control device includes period correcting means for monitoring the electrical energy stored in the charge circuit immediately before the command injection period and for estimating the electrical energy at a start of the command injection period based on the monitored value of the electrical energy, the period correcting means correcting the command injection period based on the estimated electrical energy so that the injector injects the target injection quantity of the fuel.

3. The fuel injection system as in claim 1, wherein the control device controls the electrical energy supplied from the charge circuit to the actuator to perform a multi-injection, in which multiple injections are performed in one compression and expansion stroke of the engine.

4. The fuel injection system as in claim 1, wherein the control device performs control for advancing the command injection timing in accordance with a decrease of the estimated electrical energy from a specified value when the estimated electrical energy is lower than the specified value, and the control device performs control for retarding the command injection timing in accordance with an increase of the estimated electrical energy from the specified value when the estimated electrical energy is higher than the specified value.

5. A fuel injection system for an internal combustion engine, the fuel injection system comprising:

a charge circuit for storing electrical energy;

an injector having an actuator, which is driven by the electrical energy stored in the charge circuit, and a valve member driven to open or to close directly or indirectly by the actuator, wherein the injector injects high-pressure fuel by opening and closing the valve member; and a control device for calculating a target injection quantity corresponding to an operating state of the engine and a command injection period for obtaining the target injection quantity, and for making the injector inject the target injection quantity of the fuel by supplying the electrical energy from the charge circuit to the actuator for the command injection period, wherein:

the control device includes period correcting means for monitoring the electrical energy stored in the charge circuit immediately before the command injection period and for estimating the electrical energy at a start of the command injection period based on the monitored value of the electrical energy, the period correcting means correcting the command injection period based on the estimated electrical energy so that the injector injects the target injection quantity of the fuel;

the control device performs control for lengthening the command injection period in accordance with a decrease of the estimated electrical energy from a specified value when the estimated electrical energy is lower than the specified value, and the control device performs control for shortening the command injection period in accordance with an increase of the estimated electrical energy from the specified value when the estimated electrical energy is higher than the specified value.

6. The fuel injection system as in claim 2, wherein the control device performs control for lengthening the command injection period in accordance with a decrease of the estimated electrical energy from a specified value when the estimated electrical energy is lower than the specified value, and the control device performs control for shortening the command injection period in accordance with an increase of the estimated electrical energy from the specified value when the estimated electrical energy is higher than the specified value.

7. The fuel injection system as in claim 4, wherein the control device corrects the command injection timing with a correction value in accordance with the estimated electrical energy, the correction value corresponding to a value for correcting a change in a response time of the actuator, which is caused when the electrical energy stored in the charge circuit decreases or increases from the specified value.

8. The fuel injection system as in claim 5, wherein the control device corrects the command injection period with a correction value in accordance with the estimated electrical energy, the correction value corresponding to a value for correcting a change in a response time of the actuator, which is caused when the electrical energy stored in the charge circuit decreases or increases from the specified value.

9. The fuel injection system as in claim 6, wherein the control device corrects the command injection period with a correction value in accordance with the estimated electrical energy, the correction value corresponding to a value for correcting a change in a response time of the actuator, which is caused when the electrical energy stored in the charge circuit decreases or increases from the specified value.

10. A method for controlling a fuel injection system of an internal combustion engine including a charge circuit for storing electrical energy, an injector having an actuator, which is driven by the electrical energy stored in the charge circuit, and a valve member, which is driven to open or to close by the actuator directly or indirectly, wherein the injector injects high-pressure fuel by opening and closing the valve member, said method comprising:

calculating target injection timing corresponding to an operating state of the engine and command injection timing for staffing the injection at the target injection timing;

injecting fuel at the target injection timing by supplying electrical energy from the charge circuit to the actuator at the command injection timing;

monitoring the electrical energy stored in the charge circuit immediately before the command injection timing and estimating the electrical energy at the command injection timing based on the monitored value of the electrical energy; and correcting the command injection timing based on the estimated electrical energy so that the injector injects fuel at the target injection timing.

11. The method of claim 10 further comprising:

calculating a command injection period for obtaining a target injection quantity;

injecting the target injection quantity of the fuel by supplying electrical energy from the charge circuit to the actuator for the command injection period;

monitoring electrical energy stored in the charge circuit immediately before the command injection period and estimating the electrical energy at a staff of the command injection period based on the monitored value of the electrical energy; and correcting the command injection period based on the estimated electrical energy so that the injector injects the target injection quantity of fuel.

12. A method as in claim 10 further comprising:

controlling electrical energy supplied from the charge circuit to the actuator to perform a multi-injection, in which multiple injections are performed in one compression and expansion stroke of the engine.

13. A method as in claim 10 further comprising:

controllably advancing the command injection timing in accordance with a decrease of estimated electrical energy from a specified value when the estimated electrical energy is lower than the specified value; and retarding the command injection timing in accordance with an increase of estimated electrical energy from the specified value when the estimated electrical energy is higher than the specified value.

14. A method for controlling fuel injection to an internal combustion engine using a fuel injection system including a charge circuit for storing electrical energy, an injector having an actuator, which is driven by electrical energy stored in the charge circuit, and a valve member driven to open or to close directly or indirectly by the actuator, wherein the injector injects high-pressure fuel by opening and closing the valve member, said method comprising:

calculating a target injection quantity corresponding to an operating state of the engine and a command injection period for obtaining the target injection quantity;

injecting the target injection quantity of fuel by supplying electrical energy from the charge circuit to the actuator for the command injection period;

monitoring electrical energy stored in the charge circuit immediately before the command injection period and estimating the electrical energy at a start of the command injection period based on the monitored value of the electrical energy;

correcting the command injection period based on the estimated electrical energy so that the injector injects the target injection quantity of the fuel;

lengthening the command injection period in accordance with a decrease of estimated electrical energy from a specified value when the estimated electrical energy is lower than the specified value; and shortening the command injection period in accordance with an increase of estimated electrical energy from the specified value when the estimated electrical energy is higher than the specified value.

15. A method as in claim 11 further comprising:

lengthening the command injection period in accordance with a decrease of estimated electrical energy from a specified value when the estimated electrical energy is lower than the specified value, and shortening the command injection period in accordance with an increase of estimated electrical energy from the specified value when the estimated electrical energy is higher than the specified value.

16. A method as in claim 13 further comprising:

correcting the command injection timing with a correction value in accordance with estimated electrical energy, the correction value corresponding to a value for correcting a change in response time of the actuator which is caused when electrical energy stored in the charge circuit decreases or increases from the specified value.

17. A method as in claim 14 further comprising:

correcting the command injection period with a correction value in accordance with estimated electrical energy, the correction value corresponding to a value for correcting a change in response time of the actuator which is caused when electrical energy stored in the charge circuit decreases or increases from the specified value.

18. A method as in claim 15 further comprising:

correcting the command injection period with a correction value in accordance with estimated electrical energy, the correction value corresponding to a value for correcting a change in response time of the actuator which is caused when electrical energy stored in the charge circuit decreases or increases from the specified value.

* * * * *